US010980375B2

(12) United States Patent
Ciavarella et al.

(10) Patent No.: US 10,980,375 B2
(45) Date of Patent: Apr. 20, 2021

(54) UNIVERSAL DISPENSER MOUNTING BRACKETS

(71) Applicant: GOJO Industries, Inc., Akron, OH (US)

(72) Inventors: Nick E. Ciavarella, Seven Hills, OH (US); Stephen Howe, Cuyahoga Falls, OH (US); Seth Andrew Glasgow, Stow, OH (US); Emily Barbara Kennedy, Cleveland, OH (US); Donald R. Harris, Tallmadge, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/900,853

(22) Filed: Feb. 21, 2018

(65) Prior Publication Data

US 2018/0235409 A1 Aug. 23, 2018

Related U.S. Application Data

(60) Provisional application No. 62/461,258, filed on Feb. 21, 2017.

(51) Int. Cl.

| | |
|---|---|
| ***A47K 5/12*** | (2006.01) |
| ***B05B 11/00*** | (2006.01) |
| ***A47K 3/28*** | (2006.01) |

(52) U.S. Cl.

CPC ..... *A47K 5/1211* (2013.01); *A47K 3/281* (2013.01); *A47K 5/12* (2013.01); *A47K 5/1217* (2013.01);

(Continued)

(58) Field of Classification Search

CPC ..... A47K 5/1211; A47K 3/281; A47K 5/12; A47K 5/1217; B05B 11/30; F16M 13/00;

(Continued)

(56) References Cited

U.S. PATENT DOCUMENTS 2,202,660 A 5/1940 Max
2,263,956 A 11/1941 Russell (Continued)

FOREIGN PATENT DOCUMENTS

DE 102007010794 A1 9/2008

OTHER PUBLICATIONS

International Search Report and Written Opinion from International Application No. PCT/US2018/018885 dated May 25, 2018 (15 pages).

*Primary Examiner* — Vishal Pancholi
*Assistant Examiner* — Robert K Nichols, II
(74) *Attorney, Agent, or Firm* — Calfee, Halter & Griswold LLP

(57) ABSTRACT

Exemplary embodiments of universal mounting brackets and dispensers with mounting brackets are disclosed herein. An exemplary universal dispenser mounting bracket includes a base. The base has a first surface for connecting to a dispenser. A first spring arm extends from the base in a first direction and has a first arm clamp. A second spring arm extends from the base in a second direction and has a second arm clamp. The first and second spring arms have a rest position and a biased position. Moving the first and second spring arms away from their rest position generates a clamp force in the spring arms that urges the first and second spring arms toward their rest position. When the mounting bracket is mounted to a surface, the base is on a first side of the surface and the first and second clamp arms are on a second side of the surface and the clamp force generated by the spring arms secures the mounting bracket to the surface.

20 Claims, 9 Drawing Sheets

(52) U.S. Cl.
CPC ..... *B05B 11/30* (2013.01); *A47K 2005/1218* (2013.01); *A47K 2201/00* (2013.01); *A47K 2201/02* (2013.01)

(58) Field of Classification Search
CPC ... B65D 51/242; B62J 11/02; B62B 2202/023
USPC ..... 222/180, 181.1, 181.2; 248/200, 309.1, 248/311.2, 226.11
See application file for complete search history.

(56) References Cited

U.S. PATENT DOCUMENTS 3,239,182 A 3/1966 Blanz
3,314,635 A * 4/1967 Frye ..... B60N 3/103 211/72
3,813,072 A * 5/1974 Moore ..... A47K 5/1214 211/74
3,938,769 A 2/1976 Wetherbee
5,188,327 A * 2/1993 White ..... A61G 7/0503 248/231.81
6,553,851 B1 * 4/2003 Carrico ..... B25B 5/101 24/455
2007/0039976 A1 * 2/2007 Saleh ..... A47K 5/1202 222/608
2008/0217495 A1 * 9/2008 Roepke ..... A47K 17/00 248/223.41
2013/0087579 A1 * 4/2013 Knighton ..... A61G 7/0503 222/180
2013/0262345 A1 * 10/2013 Ciavarella ..... A61L 2/0088 705/500
2014/0061230 A1 * 3/2014 Jonsson ..... A47K 5/12 221/283
2015/0083754 A1 3/2015 Proper et al.
2015/0257533 A1 9/2015 Yang et al.

* cited by examiner

UNIVERSAL DISPENSER MOUNTING BRACKETS

RELATED APPLICATIONS

This application claims priority to and the benefits of U.S. Provisional Patent Application Ser. No. 62/461,258, which was filed on Feb. 21, 2017 and titled UNIVERSAL DISPENSER MOUNTING BRACKETS, and which is incorporated herein by reference in its entirety.

TECHNICAL FIELD

The present invention relates generally to mounting brackets and more particularly to dispenser mounting brackets, such as, for example, soap and sanitizing dispensers.

BACKGROUND OF THE INVENTION

Liquid dispenser systems, such as liquid soap and sanitizer dispensers, provide a user with an amount of liquid upon actuation of the dispenser. The dispensers may be table top dispensers having a bottle and a pump secured to the bottle, in addition some are suitable for wall mounting and some have wall mounting brackets that are affixed to a wall. However, often times it would be convenient to be able to be able to releasably mount dispensers in other areas.

SUMMARY

Exemplary embodiments of universal mounting brackets and dispensers with mounting brackets are disclosed herein. An exemplary universal dispenser mounting bracket includes a base. The base has a first surface for connecting to a dispenser. A first spring arm extends from the base in a first direction and has a first arm clamp. A second spring arm extends from the base in a second direction and has a second arm clamp. The first and second spring arms have a rest position and a biased position. Moving the first and second spring arms away from their rest position generates a clamp force in the spring arms that urges the first and second spring arms toward their rest position. When the mounting bracket is mounted to a surface, the base is on a first side of the surface and the first and second clamp arms are on a second side of the surface and the clamp force generated by the spring arms secures the mounting bracket to the surface.

An exemplary dispenser includes a housing, a receptacle for receiving a container and a mounting bracket. The mounting bracket has a first spring arm extending in a first direction. The first spring arm having a first arm clamp. The mounting bracket has a second spring arm extending in a second direction and the second spring arm having a second arm clamp. The first and second spring arms have a rest position and a biased position. Moving the first and second spring arms away from their rest position generates a clamp force in the spring arms that urges the first and second spring arms toward their rest position.

Another exemplary dispenser includes a housing. The housing has a receptacle for receiving a container. The housing having one or more retaining clips for securing one or more spring arms to the housing. The one or more spring arms have one or more clamp arms. When the one or more spring arms are moved from their resting position a clamp force is generated in the one or more spring arms and the clamp force secures the dispenser to a surface.

In this way, a simple and economical universal mounting brackets are provided.

BRIEF DESCRIPTION OF THE DRAWINGS

These and other features and advantages of the present invention will become better understood with regard to the following description and accompanying drawings in which.

DETAILED DESCRIPTION

Figure 2:
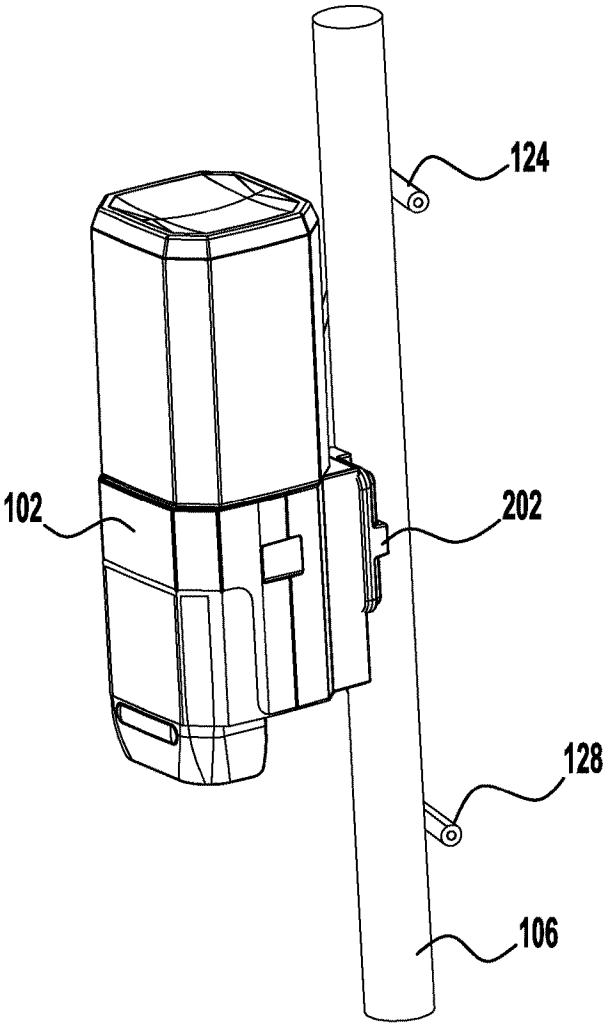
FIG. 2 is another prospective view of the dispenser mounted to the cylindrical surface with the novel universal mounting bracket of FIG. 1.
Figure 1:
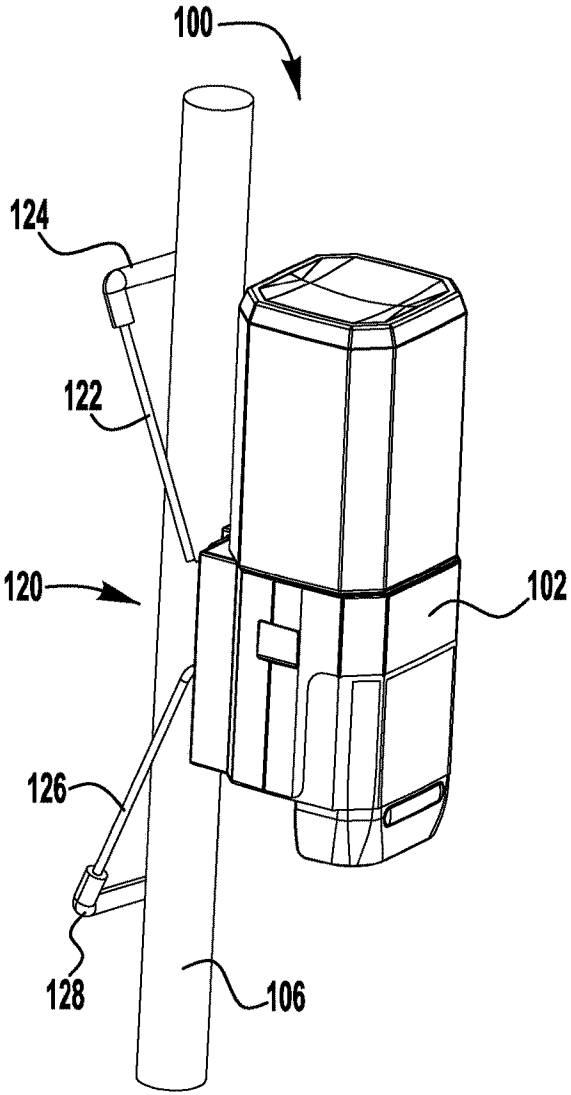
FIG. 1 is a prospective view of a dispenser mounted to a cylindrical surface with the novel universal mounting bracket.

FIGS. 1 and 2 are prospective views of an exemplary dispenser 102 mounted to a cylindrical surface 106 with a novel universal mounting bracket 120. Universal mounting bracket 120 includes a base 202. Extending from base 202 in a first direction is first spring arm 122 and first arm clamp 124. Extending from base 202 in a second direction is second spring arm 126 and second arm clamp 128. Dispenser 102 is connected to base 202.

In this embodiment, dispenser 102 is a manual dispenser with a pushbar 103 that is pushed to dispense product. However, dispenser 102 may be any type of dispenser. In some embodiments dispenser 102 is a touch-free dispenser. In some embodiments, dispenser is a bottle having a manual push-pump located on the top of the bottle. Exemplary dispensers may be, for example, a touch-free dispenser or a manual dispenser. Exemplary touch-free and manual dispensers are described in, for example, U.S. Pat. No. 8,960,498 titled Touch-Free Dispenser with Single Cell Operation and Battery Banking and U.S. Pat. No. 9,172,266 titled Power Systems For Touch Free Dispensers and Refill Units Containing a Power Source, U.S. Pat. No. 8,485,395 titled Dispenser Lockout Mechanism, US Pat. App. No. 2015/0053720 titled Dispenser Having Top Loading and Unloading Refill Units, and U.S. Pat. No. 8,091,738 titled Manual Skin-Care Product Dispenser, all of which are incorporated herein by reference. The exemplary dispensers described herein are typically used for dispensing soap, sanitizer or lotion into the hand of a user, however, other types of dispensers may be mounted to a surface utilizing the exemplary embodiments of the universal mounting brackets disclosed herein.

First and second spring arms 122, 126 and first and second arm clamps 124 and 128 are made out of a resilient material that when flexed or moved from its rest position under force, returns to its original shape when the force is removed. Exemplary material may be, for example, spring steel. Objects made of spring steel to return to their original shape despite significant deflection or twisting. Other types of material may be for example, other resilient metals including; austenitic and precipitation hardening stainless steels such as, for example, type 301, 302, 304 316, 430, 440 and type 17-7, brass, copper, bronze and resilient plastics including POM, Nylon and PEI glass filled or non-filled, glass filled PE, HDPE, PP, ABS and composite plastics such as carbon fiber and aramid fiber infused with previously mentioned plastic types and soft or hardwoods including pine, oak, hickory, ash, maple, redwood, and vulcanized hard rubber.

During use, the base 202 is connected to dispenser 102. (In some embodiments, base 202 is connected to the dispenser 102 after the bracket 120 is connected to the surface). First and second spring arms 122, 126 are bent outward from the dispenser 102, which creates a clamping force as the spring arms 122, 126 will attempt to move back to their original positions. Bracket 120 is moved into position such that base 202 is located on a first side of cylindrical surface 106 and first and second clamp arms 124, 128 are located on a second side of the cylindrical surface 106. The spring arms 122, 126 are released and the universal mounting bracket 120 is secured to the body cylindrical surface 106 and retains dispenser 102 in a desired position.

Figure 3:
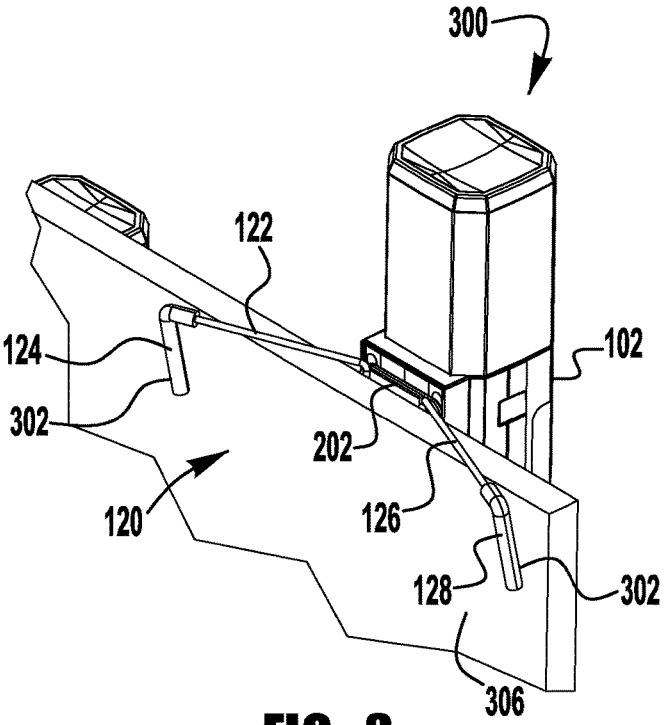
FIG. 3 is a prospective view of a dispenser mounted to the top of a partition surface with the novel universal mounting bracket.

FIG. 3 is a prospective view of exemplary dispenser 102 mounted to the top of a partition surface 306 with the novel universal mounting bracket 120. As described above, universal mounting bracket 120 includes a base 202. Extending from base 202 in a first direction is first spring arm 122 and first arm clamp 124. Extending from base 202 in a second direction is second spring arm 126 and second arm clamp 128. In this exemplary embodiment, base 202 is connected to dispenser 102 with one or more fasteners. In some embodiments, base 202 is connected to dispenser 102 with and adhesive tape, and in some embodiments with one or more quick connectors, one or more magnets, one or more hook and loop fasteners (e.g. Velcro®), one or more clips, an intermediate mounting plate, or the like. In addition, mounting bracket 120 includes clamp grips 302. Clamp grips 302 cover first and second clamp arms 124, 128. In this exemplary embodiment, Spring arms 122, 126 are connected to base 202 at a 90° orientation so that universal mounting bracket 120 may connect to the top the partition wall 306.

During use, the base 202 is connected to dispenser 102. (In some embodiments, base 202 is connected to the dispenser 102 after the bracket 120 is connected to the surface). First and second spring arms 122, 126 are bent outward from the dispenser 102, which creates a clamping force as the spring arms 122, 126 will attempt to move back to their original positions. Bracket 120 is moved into position over the top of partition wall 306 such that base 202 is located on a first side of partition wall 306 and first and second clamp arms 124, 128 are located on a second side of the partition wall 306. The spring arms 122, 126 are released and the bracket 120 clamps the partition wall 306 and retains dispenser 102 in a desired position.

Figure 4:
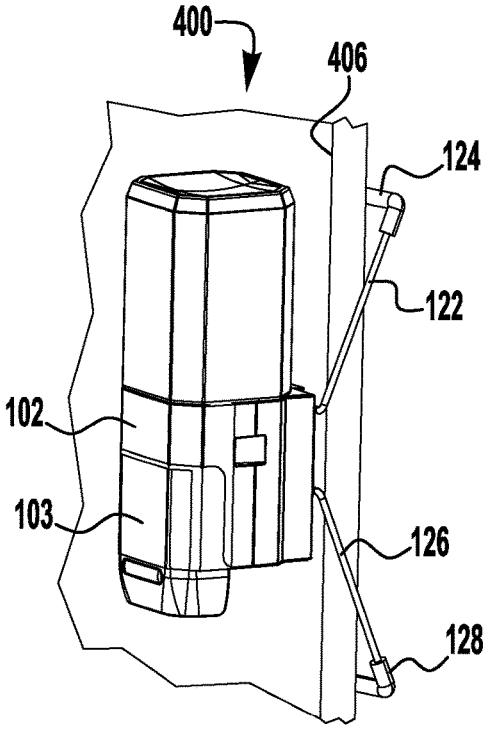
FIG. 4 is a prospective view of a dispenser mounted to the side of a partition surface with the novel universal mounting bracket.

FIG. 4 is a prospective view of dispenser mounted 102 to the side of a partition surface 306 with the novel universal mounting bracket 102. As described above, during use, the base 202 is connected to dispenser 102 in a 180° vertical position. (In some embodiments, base 202 is connected to the dispenser 102 after the bracket 120 is connected to the surface). First and second spring arms 122, 126 are bent outward from the dispenser 102, which creates a clamping force as the spring arms 122, 126 will attempt to move back to their original positions. Bracket 120 is moved into position on the side of partition wall 406 such that base 202 is located on a first side of partition wall 406 and first and second clamp arms 124, 128 are located on a second side of the partition wall 406. The spring arms 122, 126 are released and the bracket 120 clamps the partition wall 406 and retains dispenser 102 in a desired position.

Figure 5:
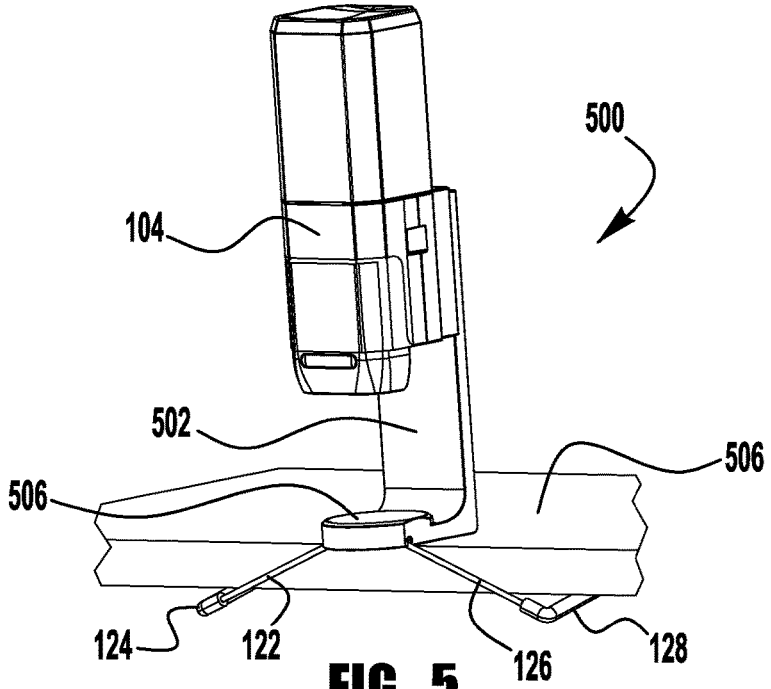
FIG. 5 is a prospective view of a dispenser mounted to the counter top surface with the novel universal mounting bracket.

FIG. 5 is a prospective view of another dispenser 104 mounted to the counter top surface 506 with the novel universal mounting bracket 120. In this embodiment, dispenser 104 includes a drip tray 506 and extension 502. As described above, during use, the base 202 is connected to dispenser 104 at the bottom of the drip tray 506. In some embodiments, dispenser 104 dispenses from the top and a drip tray is not needed. In such case, the base 202 may be mounted to the bottom of the dispenser 104 or bottom of the container. (In some embodiments, base 202 is connected to the dispenser 104 after the bracket 120 is connected to the surface). As described above, first and second spring arms 122, 126 are bent outward from the dispenser 104, which creates a clamping force as the spring arms 122, 126 will attempt to move back to their original positions. Bracket 120 is moved into position on the side of counter top surface 506 such that base 202 is located on a first side of countertop surface 506 and first and second clamp arms 124, 128 are located on a second side of the counter top surface 506. The spring arms 122, 126 are released and the bracket 120 secures dispenser 104 to countertop 506 in a desired position.

Figure 6:
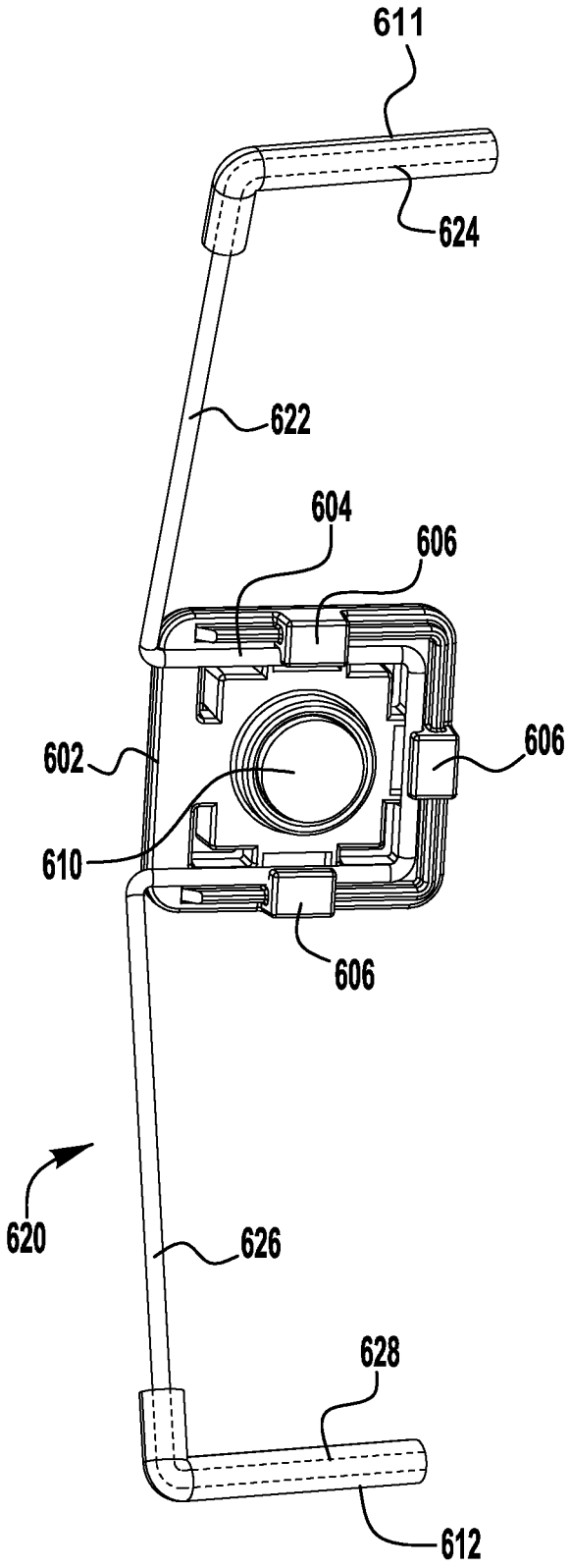
FIG. 6 is another exemplary embodiment of a novel universal mounting bracket.

FIG. 6 is another exemplary embodiment of a novel universal mounting bracket 620. Universal mounting bracket 620 includes a base 602. Base 602 includes a plurality of retaining clips 606. Extending from base 602 in a first direction is first spring arm 622 and first arm clamp 624. Extending from base 602 in a second direction is second spring arm 626 and second arm clamp 628. Clamp grips 611, 612 are located over clamp arms 624, 628 to help grip the clamping surface and/or also protect the clamping surface. In some embodiments, clamp grips 611, 612 are an elastomer. In some embodiments, clamp grips 611, 612 are a plastic. Located on base 602 is a surface contact pad 610. Surface contact pad 610 protects the clamping surface, and/or provides extra grip for the mounting bracket 620 and helps prevent universal mounting bracket 620 from sliding with respect to the surface it is mounted on. In some embodiments, surface contact pad 610 is made of an elastomer. In some embodiments, surface contact pad 610 has a contoured surface that correlates to the surface the mounting bracket 620 is to be mounted on. For example, contoured surface may have a surface with the same radius as a post or rail that is clamped to. In some embodiments, the contoured surface seals against the surface is being mounted on forming a suction cup type engagement with the surface the mounting clamp as being connected to. The size and shape of surface contact pad 610 may be any shape, and in some embodiments, is sized based upon the mounting surface. In some embodiments, surface contact pad 610 is sized based upon the weight or size of the dispenser is being mounted on the universal mounting bracket 620.

First and second spring arms 622, 626 are made out of a resilient material that when flexed or moved from its rest position under force, returns to its original shape when the force is removed. Exemplary material may be for example, spring steel. Objects made of spring steel to return to their original shape despite significant deflection or twisting. Other types of material may be for example, other resilient metals including; austenitic and precipitation hardening stainless steels such as, for example, type 301, 302, 304 316, 430, 440 and type 17-7, brass, copper, bronze and resilient plastics including POM, Nylon and PEI glass filled or non-filled, glass filled PE, HDPE, PP, ABS and composite plastics such as carbon fiber and aramid fiber infused with previously mentioned plastic types and soft or hardwoods including pine, oak, hickory, ash, maple, redwood, and vulcanized hard rubber. In this exemplary embodiment, first and second spring arms 622, 626 and first and second clamp arms 624, 628 are made of a single unitary piece. In this exemplary embodiment, located in the center of the unitary piece is a u-shaped portion 604. U-shaped portion 604 connects first and second spring arms 622, 626 to base 606. In some embodiments, first and second spring arms 622, 626 are separate parts and separately connect to base 606.

Figure 6A:
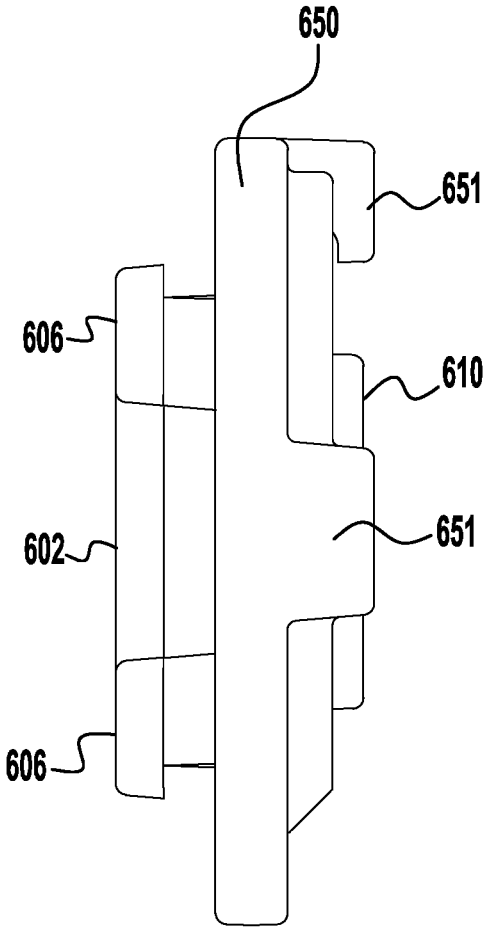
FIG. 6A is an exemplary embodiment of a dispenser mounting plate mounted to a bracket base.

FIG. 6A is an exemplary embodiment of a dispenser mounting plate 650 that is mounted to a bracket base 602. Dispenser mounting plate 650 is connected to a dispenser (not shown) and has clips 651. There are three clips 651, one on each side and one on the top. In this exemplary embodiment, mounting plate 650 slides over base 602 and secures a dispenser thereto. Mounting plate 650 may be connected to the dispenser by any means, such as, for example, fasteners, double sided tape, hook and loop fastener, magnetic coupling, adhesive, or the like.

Figure 7:
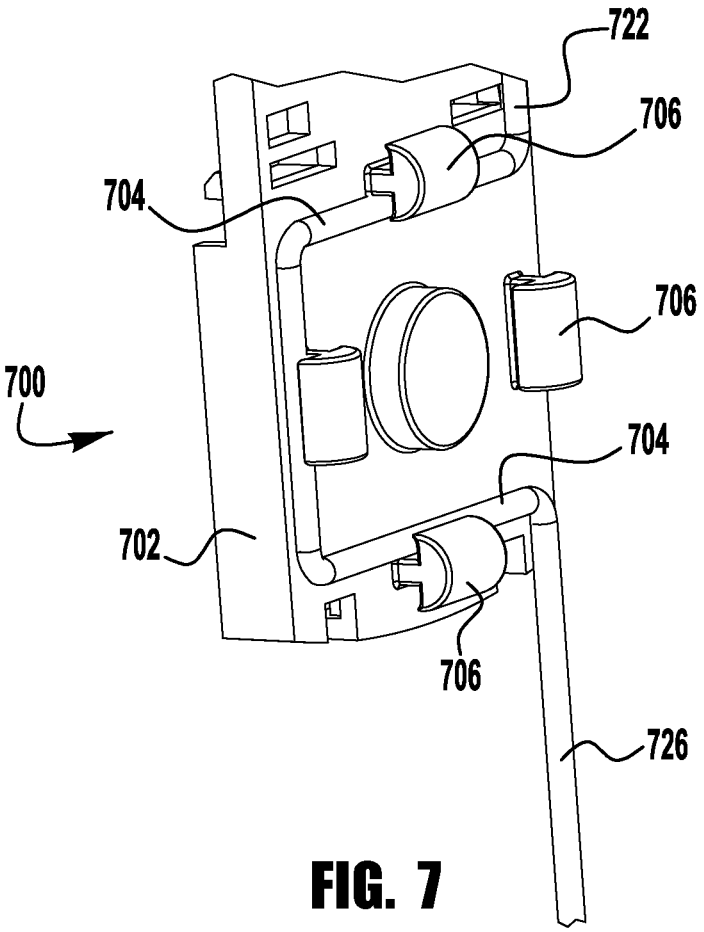
FIG. 7 is an exemplary embodiment of a mounting bracket base.

FIG. 7 is an exemplary embodiment of a mounting bracket base 702. Mounting bracket base 702 includes a plurality of retaining clips 706. Retaining clips 706 retain the u-shaped portion 704 of spring arms 722, 726 (only a partial view of spring arms 722, 726 are shown) to base 702. In this embodiment three retaining clips 706 are needed to retain the spring arms. In this embodiment, there are four retaining clips 706. In this way, the spring arms 722, 726 can be mounted to the base 702 so that spring arms 726 extend outward from the base 702 in four different positions. In this exemplary embodiment, clips 706 are also configured so that u-shaped portion can be retained on either side of the clip 706. Clip 706 uses the "spring" force generated by u-shaped member 604 to hold u-shaped member in place.

Figure 8:
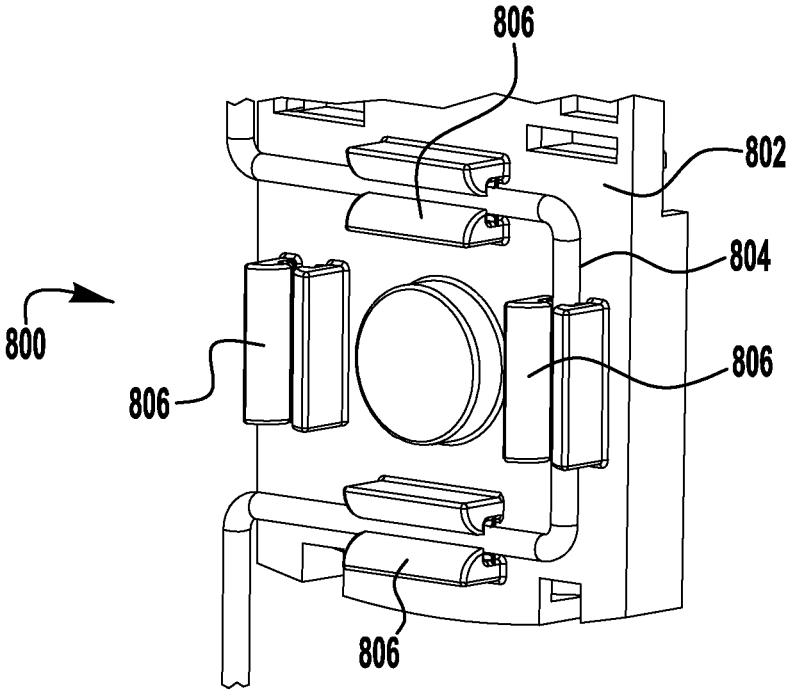
FIG. 8 is another exemplary embodiment of a mounting bracket base.

FIG. 8 is another exemplary embodiment of a mounting bracket base 802. Mounting bracket base 802 is similar to mounting bracket 702 but has a different type of clips 806. Clip 806 snaps around u-shaped member 804.

Figure 9:
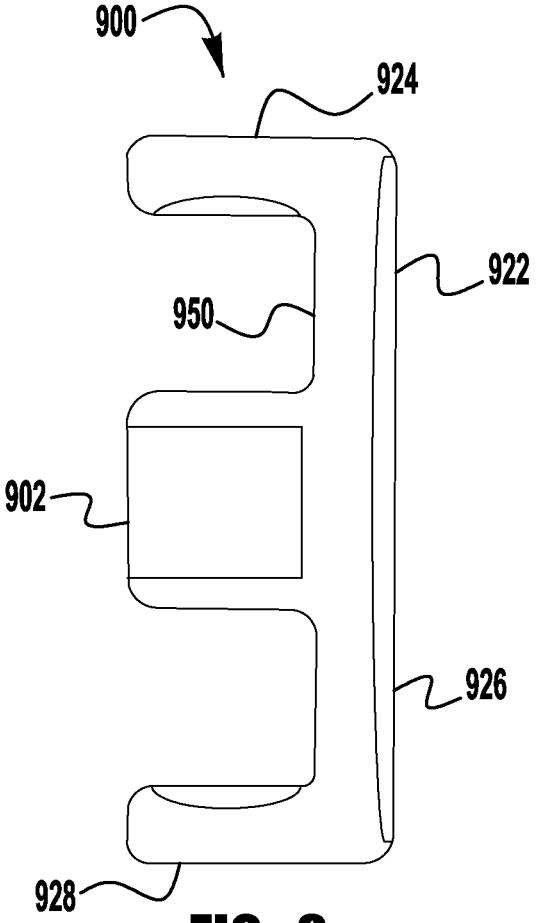
FIG. 9 is an exemplary embodiment of a universal mounting bracket.

FIG. 9 is another exemplary embodiment of a universal mounting bracket 900. Mounting bracket 900 includes first and second spring arms 922, 926 and first and second clamp arms 924, 928. In addition, mounting bracket 900 includes a base 902. Mounting bracket 900 includes an elastomer coating 950 over the entire bracket. In some embodiments only a portion of the bracket 900 includes the elastomer coating 950. The elastomer coating 950 makes the mounting bracket 900 easy to clean and sanitize, and also helps grip the mounting surface. In some embodiments, the elastomer coating surrounds a base, spring arms and arm clamps made of materials as described above. In some embodiments, mounting bracket 900 is made entirely of elastomer. In some embodiments, base 902 includes a magnetic material for mounting to the dispenser and/or for aiding in gripping of the surface. In some embodiments, base 902 includes a metallic member.

Figure 10:
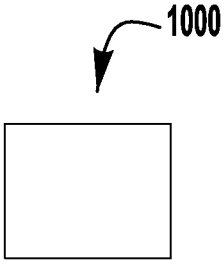
FIG. 10 is an exemplary embodiment of a dispenser mounting plate for connecting a dispenser to the universal mounting bracket.

FIG. 10 is an exemplary embodiment of a dispenser mounting plate 1000 for connecting a dispenser to the universal mounting bracket 900. Dispenser mounting plate 1000 may include a metallic plate if mounting bracket 900 contains magnetic material. In some embodiments, dispenser mounting plate 1000 comprises an adhesive, one or more hook and loop fasteners, double sided tape or the like for connecting to the universal mounting bracket 900 and/or a dispenser (not shown).

Figure 11:
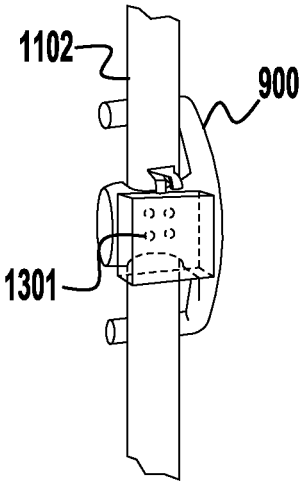
FIGS. 11 and 12 are views of the exemplary universal mounting bracket of FIG. 9 mounted to a cylindrical surface.
Figure 12:
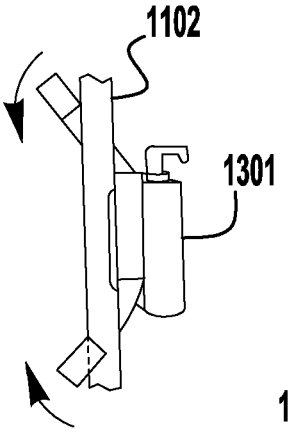
Figure 13:
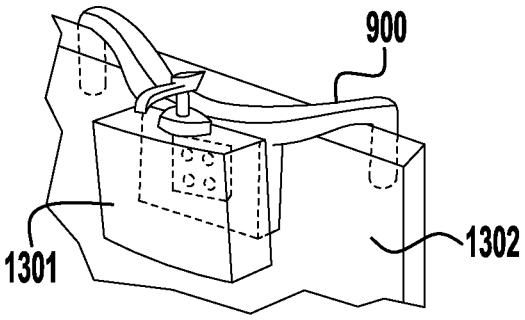
FIG. 13 is a prospective view of the exemplary universal mounting bracket of FIG. 9 mounted to a partition.

FIGS. 11 and 12 are views of the exemplary universal mounting bracket 900 mounted to a cylindrical surface. In this embodiment, dispenser 1301 is fastened to mounting bracket 900. Mounting bracket 900 is mounted to the cylindrical surface 1102, or partition surface 1302 (FIG. 13) as described above.

Figure 14:
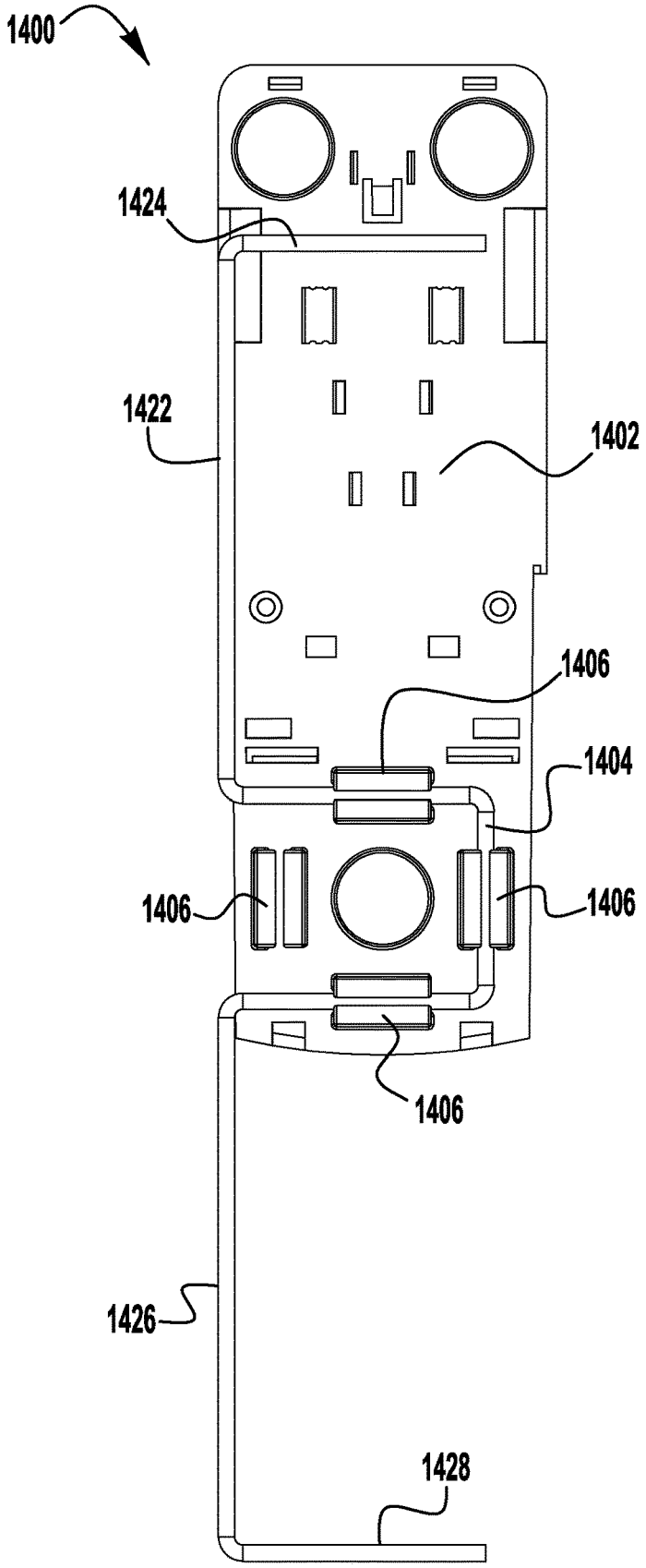
FIG. 14 is a rear view of an exemplary dispenser having a back plate with an integrated base for the mounting bracket.

FIG. 14 is a rear view of an exemplary dispenser 1400 having a back plate 1402. Back plate 1402 has a plurality of retaining clips 1406 integrally formed therein. The retaining clips 1406 retain u-shaped portion 1404 of spring arms 1422, 1426, and clamp arms 1424, 1428 and functions as described above.

Figure 15A:
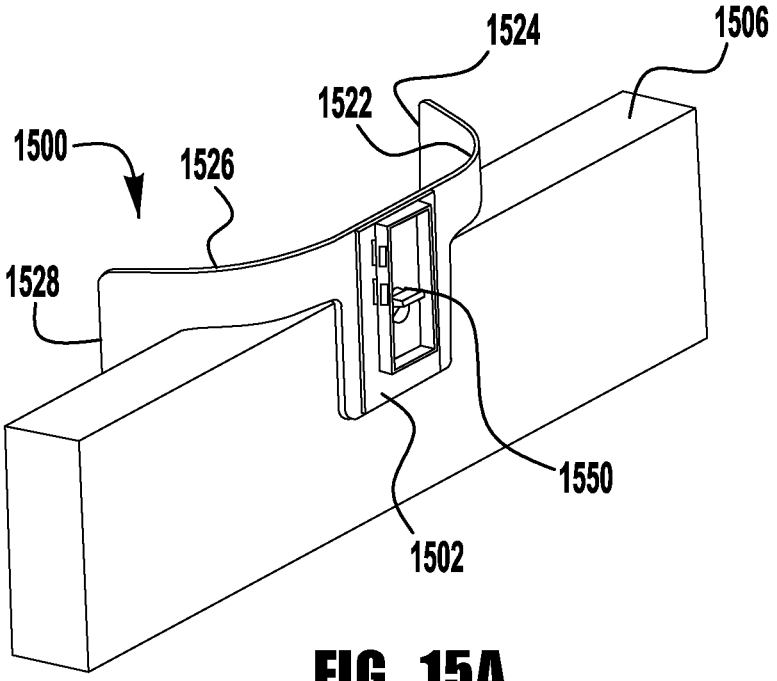
FIGS. 15A and 15B illustrate another exemplary embodiment of a universal mounting bracket.
Figure 15B:
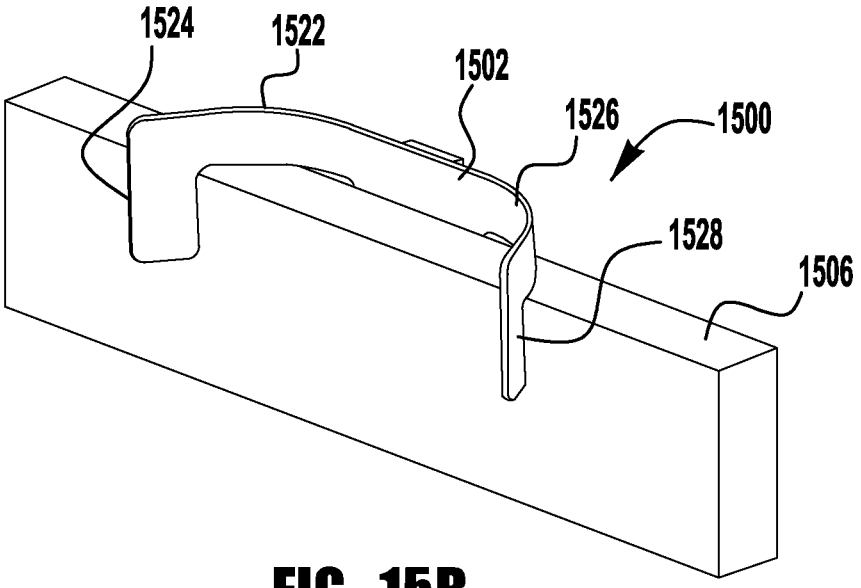

FIGS. 15A and 15B illustrate another exemplary embodiment of a universal mounting bracket 1500. Universal mounting bracket 1500 includes a first spring arm 1522, first arm clamp 1524, second spring arm 1526, second arm clamp 1528 and base 1502. Secured to base 1502 is bracket 1550 for connecting to a dispenser (not shown). In this exemplary embodiment, first spring arm 1522, first arm clamp 1524, second spring arm 1526, second arm clamp 1528 and base 1502 are a unitary piece, and are made from a material such as for example spring steel, or the other materials described herein that would perform the same function. In this exemplary embodiment, first spring arm 1522, first arm clamp 1524, second spring arm 1526, second arm clamp 1528 and base 1502 are flat, however it could have various shapes and thicknesses.

Figure 16:
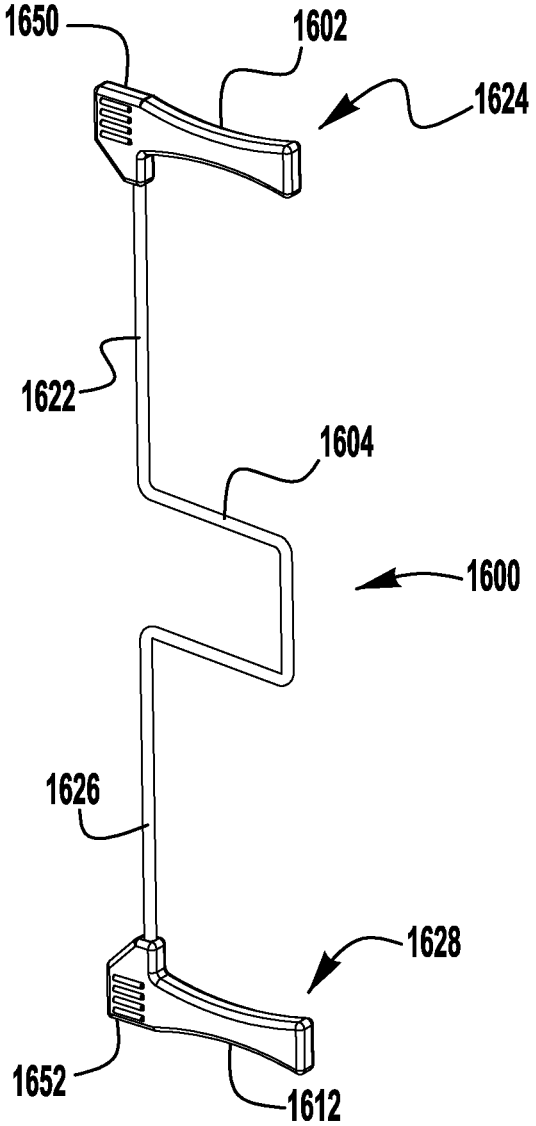
FIG. 16 is another exemplary embodiment of spring arms for a universal mounting bracket.

FIG. 16 is another exemplary embodiment of spring arms and clamps 1600 for a universal mounting bracket. U-shaped portion 1604 first spring arm 1622 seconds spring arm 1626 and arm clamps 1624 and second arm clamp 1628 are similar to those described above and are not re-described herein. Clamp grips 1602 and 1612 include tabs 1650 and 1652 that may be used when manipulating spring arms 1622 and 1626. Clamp grips 1602 and 1612 have a slightly arcuate shape and a thicker and which are designed to aid in gripping the mounting surface.

Figure 17:
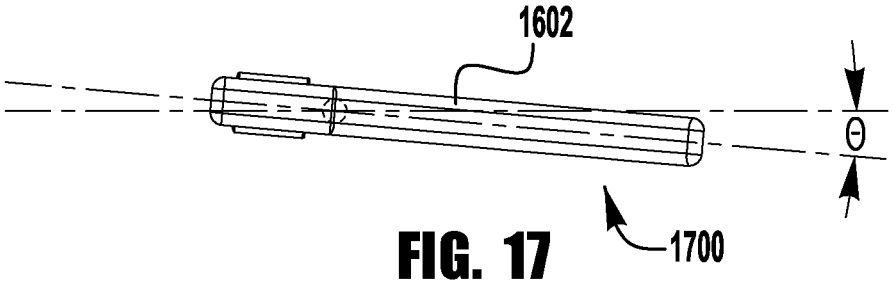
FIG. 17 is partial view of another exemplary embodiment of an arm clamp on a spring arm.

FIG. 17 is partial view of another exemplary embodiment of an arm clamp 1700 on a spring arm. FIG. 17 illustrates a pre-bend in arm clamp 1602. In this exemplary embodiment, the arm clamp is bent so that at rest position the arm clamp 1602 extends at an angle and is not parallel to the base (not shown). In some embodiments, the angle of the pre-bend is between about 3° at about 15°. The pre-bend is in the direction that is away from the surface that the arm clamp 1602 will engage when the mounting bracket is connected to a surface.

Figure 18:
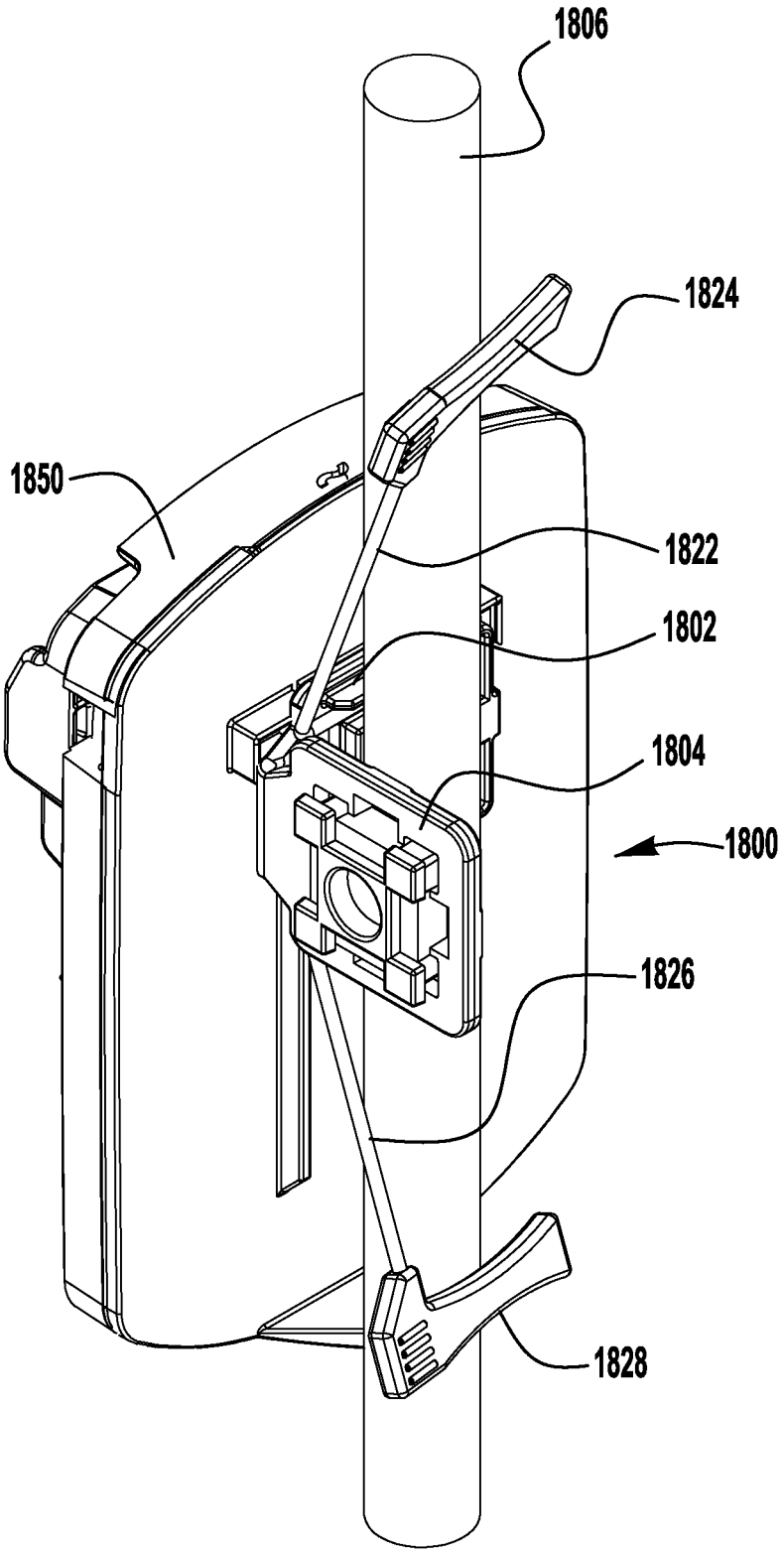
FIG. 18 is another exemplary embodiment of a universal mounting bracket for mounting multiple devices.

FIG. 18 is another exemplary embodiment of a universal mounting bracket 1800 for mounting multiple devices. Universal mounting bracket 1800 has similar components to those described above including a base 1802 for spring arm 1822, second spring arm 1826, first arm clamp 1824, and second arm clamp 1828. In addition, universal mounting bracket 1800 includes a second base 1804 for mounting a second dispenser (not shown). has can be seen a dispenser mounting plate 1850 is connected to base 1802 and there is room for a second dispenser to be mounted to base 1804.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A dispenser mounting bracket comprising:
a base;
the base having a first surface for connecting to a dispenser;
a plane extending along the first surface;
a first spring arm extending from the base in a first direction;
the first spring arm having a first arm clamp;
the first arm clamp extending in a direction that is different than the first direction;
a second spring arm extending from the base in a second direction;
the second spring arm having a second arm clamp;
the second clamp arm extending in a direction that is different than the second direction;
wherein the first direction and the second direction are substantially opposite directions;
wherein the first and second spring arms have a rest position and a biased position and wherein moving the first and second spring arms away from their rest position generates a clamp force in the spring arms that urges the first and second spring arms toward their rest position;
wherein
the base and the first and second clamp arms are on substantially opposite sides of a surface when the mounting bracket is mounted to the surface;
and
the clamp force generated by the spring arms urges the first and second clamp arms in the direction of the plane and secures the mounting bracket to the surface.

2. The dispenser mounting bracket of claim 1 wherein the first spring arm and the second spring arm are part of a unitary piece.

3. The dispenser mounting bracket of claim 2 wherein a portion of the unitary piece has a u-shape portion.

4. The dispenser mounting bracket of claim 2 the unitary piece is made of spring steel.

5. The dispenser mounting bracket of claim 1 wherein the first and second spring arms are made of spring steel.

6. The dispenser mounting bracket of claim 1 further comprising a clamp grip covering at least a portion of the first and second arm clamp arms.

7. The dispenser mounting bracket of claim 1 further comprising a mounting pad located on the base.

8. The dispenser mounting bracket of claim 7 wherein the mounting pad is made of a resilient material.

9. The dispenser mounting bracket of claim 7 wherein at least a portion of the mounting pad is curved for mounting to a curved surface.

10. The dispenser mounting bracket of claim 1 further comprising one or more retaining clips for connecting the base to the first and second spring arms.

11. The dispenser mounting bracket of claim 1 further comprising elastomer surrounding at least a portion of the mounting bracket.

12. A dispenser comprising:
housing;
container;
a mounting bracket;
the mounting bracket having a back surface;
the back surface configured to contact a mounting surface;
the mounting bracket having a first spring arm extending in a first direction;
the first spring arm having a first arm clamp;
a second spring arm extending in a second direction;
the second spring arm having a second arm clamp;
wherein the first and second spring arms have a rest position and a biased position and wherein moving the first and second spring arms away from their rest position generates a clamp force in the spring arms that urges the first and second spring arms toward the mounting surface; and
wherein when mounted to a structure, the mounting bracket is located on a first side of the structure and the first spring arm and the second spring arm extend from the mounting bracket on the first side of the structure to a second side of the structure;
wherein the mounting bracket and the first and second clamp arms are located on substantially opposite sides of the structure when mounted to the structure; and
wherein the first and second arm clamps clamp against the second side of the structure.

13. The dispenser of claim 12 wherein the dispenser includes a container having pump connected to the container.

14. A dispenser comprising:
housing;
the housing having a receptacle for receiving a container;
the housing having one or more retaining clips securing one or more spring arms to the housing;
wherein the housing is configured to mount against a first side of a mounting surface;
the one or more spring arms having one or more clamp arms;
wherein the one or more spring arms extend in a first direction and the one or more clamp arms extend in a second direction that is different from the first direction;
wherein the one or more spring arms extend from the housing on the first side of the mounting surface to a second side of the mounting surface and the one or more clamp arms are configured to engage the second side of the mounting surface when the dispenser is mounted to the mounting surface;

wherein the one or more clamp arms and the housing are on substantially the opposite sides of the mounting surface when mounted to the surface; and wherein when the one or more spring arms are moved from their resting position a clamp force is generated in the one or more spring arms;

and wherein the clamp force causes the one or more clamp arms to engage the second side of the mounting surface; and the clamp force causes the housing to engage the first side of the mounting surface to secures the dispenser to the surface.

15. The dispenser of claim 14 wherein the one or more retaining clips are located on a back of the housing.

16. The dispenser of claim 14 wherein the one or more retaining clips are located on a bottom of the housing.

17. The dispenser of claim 14 further comprising an elastomer surrounding at least a portion of the one or more spring arms and one or more clamp arms.

18. The dispenser of claim 14 wherein the dispenser the dispenser includes a container having pump connected to the top of the container.

19. The dispenser of claim 14 wherein the dispenser the dispenser includes a container having pump connected to the bottom of the container.

20. The dispenser of claim 14 wherein the dispenser is a touch free dispenser.

* * * * *